US010987544B2

(12) United States Patent
Root, Jr.

(10) Patent No.: US 10,987,544 B2
(45) Date of Patent: Apr. 27, 2021

(54) FORCE PROFILE CONTROL FOR THE APPLICATION OF HORIZONTAL RESISTIVE FORCE

(71) Applicants: Southern Research Institute, Birmingham, AL (US); The UAB Research Foundation, Birmingham, AL (US)

(72) Inventor: Daniel W. Root, Jr., Chelsea, AL (US)

(73) Assignees: SOUTHERN RESEARCH INSTITUTE, Birmingham, AL (US); THE UAB RESEARCH FOUNDATION, Birmingham, AL (US)

( * ) Notice: Subject to any disclaimer, the term of this patent is extended or adjusted under 35 U.S.C. 154(b) by 326 days.

(21) Appl. No.: 15/584,424

(22) Filed: May 2, 2017

(65) Prior Publication Data

US 2017/0312582 A1 Nov. 2, 2017

Related U.S. Application Data

(60) Provisional application No. 62/330,578, filed on May 2, 2016.

(51) Int. Cl.
*A63B 24/00* (2006.01)
*A63B 21/055* (2006.01)
(Continued)

(52) U.S. Cl.
CPC ..... *A63B 24/0087* (2013.01); *A63B 21/04* (2013.01); *A63B 21/0552* (2013.01);
(Continued)

(58) Field of Classification Search
CPC ..... A63B 24/0087; A63B 22/02; A63B 21/04; A63B 21/0552; A63B 21/4009;
(Continued)

(56) References Cited

U.S. PATENT DOCUMENTS 1,016,729 A * 2/1912 Barrett ..... A63B 22/02 482/54
4,600,016 A * 7/1986 Boyd ..... A61B 5/1038 600/592
(Continued)

FOREIGN PATENT DOCUMENTS

DE 102014004997 A1 10/2015
ES 2257177 A1 7/2006
(Continued)

OTHER PUBLICATIONS

Farris (2016) "Emulating constant acceleration locomotion mechanics on a treadmill", Journal of Biomechanics 49: 653-658.
(Continued)

*Primary Examiner* — Joshua Lee
*Assistant Examiner* — Shila Jalalzadeh Abyaneh
(74) *Attorney, Agent, or Firm* — Ballard Spahr LLP

(57) ABSTRACT

Systems and methods for controlling application of horizontal resistive force to a user walking on a treadmill to provide substantially constant force even if the user changes his or her relative position on the treadmill. The systems and methods can improve the user experience when force is applied while also improving user safety. The system has a cable, a motor, and a system controller. The cable can be coupled to a harness to apply a horizontal resistive force to a treadmill user, and the motor can be coupled to the cable and configured to apply a motor force to the cable. The cable can have an adjustable operative length. The system controller can have a processor communicatively coupled to the motor and configured to adjust the force applied by the motor in response to changes in cable length and a measurement of the actual force applied by the cable.

20 Claims, 11 Drawing Sheets

(51) Int. Cl.
*A63B 21/04* (2006.01)
*A63B 21/00* (2006.01)
*A63B 22/02* (2006.01)

(52) U.S. Cl.
CPC ..... *A63B 21/4009* (2015.10); *A63B 22/02* (2013.01); *A63B 2220/51* (2013.01)

(58) Field of Classification Search
CPC ..... A63B 2220/51; A63B 22/00; A63B 23/00; A63B 24/00; A63B 21/00; A63B 69/0057; A63B 21/0442; A63B 21/018; A63B 21/045; A63B 21/0455; A63B 21/05; A63B 21/055; A63B 21/15; A63B 21/151; A63B 21/152; A63B 21/153; A63B 21/40; A63B 21/4001; A63B 21/4007; A63B 21/4011; A63B 21/4013; A63B 21/4015; A63B 21/4017; A63B 21/4019; A63B 21/4021; A63B 21/4043; A63B 21/00043; A63B 21/072; A61H 3/00; A61H 3/008; A61H 2003/007; A61H 1/0218; A61H 1/0262
See application file for complete search history.

(56) References Cited

U.S. PATENT DOCUMENTS 5,048,826 A * 9/1991 Ryan ..... A63B 21/00181 482/7
5,070,816 A * 12/1991 Wehrell ..... A63B 21/00069 119/702
5,234,392 A * 8/1993 Clark ..... A63B 69/0035 482/112
5,242,339 A * 9/1993 Thornton ..... A63B 22/02 482/54
5,391,080 A * 2/1995 Bernacki ..... A63B 69/12 434/254
5,444,812 A * 8/1995 Thibodeau ..... A63B 22/02 388/838
5,588,938 A * 12/1996 Schneider ..... A63B 21/153 482/1
5,919,119 A * 7/1999 Bohmer ..... A63B 22/02 482/54
6,123,649 A * 9/2000 Lee ..... A63B 21/153 482/51
6,126,575 A * 10/2000 Wang ..... A63B 22/0257 482/51
6,454,679 B1 * 9/2002 Radow ..... A63B 22/0235 482/4
6,554,747 B1 * 4/2003 Rempe ..... A63B 21/04 482/38
6,575,876 B1 6/2003 Phelps-McMillon
6,620,043 B1 * 9/2003 Haseltine ..... A63F 13/218 463/7
7,066,865 B2 6/2006 Radow
7,125,388 B1 * 10/2006 Reinkensmeyer ..... A63B 69/0064 601/5
7,381,163 B2 6/2008 Gordon et al.
7,780,573 B1 8/2010 Carmein
7,901,325 B2 * 3/2011 Henderson ..... A63B 69/0028 482/8
7,998,040 B2 * 8/2011 Kram ..... A63B 21/4013 482/124
8,147,382 B2 4/2012 Eldridge
8,152,699 B1 * 4/2012 Ma ..... A63B 21/4011 482/69
8,172,729 B2 5/2012 Ellis
8,257,284 B2 9/2012 Gruben et al.
8,366,589 B2 * 2/2013 Tyree ..... A63B 5/16 482/19
8,920,347 B2 12/2014 Bayerlein et al.
9,254,417 B2 2/2016 Lawrence
9,713,439 B1 * 7/2017 Wu ..... A61B 5/11
10,039,684 B2 * 8/2018 Meuleman ..... A61H 1/0237
2005/0164843 A1 * 7/2005 Papadopoulos ..... A63B 22/02 482/61
2008/0200118 A1 * 8/2008 Kubo ..... H04N 1/00307 455/14
2009/0215588 A1 * 8/2009 Riener ..... A61H 1/0237 482/7
2011/0218076 A1 * 9/2011 Lawrence ..... A63B 24/00 482/4
2011/0237399 A1 * 9/2011 Toback ..... A63B 21/0442 482/8
2013/0158444 A1 * 6/2013 Herr ..... A63B 21/00181 601/23
2014/0038777 A1 * 2/2014 Bird ..... A63B 21/151 482/5
2014/0378279 A1 12/2014 Park et al.
2015/0126344 A1 * 5/2015 Wehrell ..... A63B 24/0087 482/128
2015/0297934 A1 * 10/2015 Agrawal ..... A61H 1/0266 482/4
2016/0074697 A1 * 3/2016 Clarke ..... A63B 21/4035 273/451
2016/0325131 A1 * 11/2016 Wehrell ..... A63B 23/0405
2016/0338896 A1 * 11/2016 Gruben ..... A61H 1/0262
2017/0027803 A1 * 2/2017 Agrawal ..... A61B 5/224
2017/0274248 A1 * 9/2017 Brown ..... A63B 21/154
2019/0060708 A1 * 2/2019 Fung ..... A63F 13/65

FOREIGN PATENT DOCUMENTS

WO WO-2014/177787 A1 11/2014
WO WO-2016/033024 3/2016

OTHER PUBLICATIONS

Hurt (2015) "Effect of progressive horizontal resistive force on the comfortable walking speed of individuals poststroke", Journal of NeuroEngineering and Rehabilitation 12:12.
Novotny (2013) "A harness for enhanced comfort and loading during treadmill exercise in space", Acta Astronautica 89: 205-214.
Powell (2014) "Testing of high speed ground reaction force treadmill for kinetic analysis for running in static and dynamic loading conditions" retrieved from: [http://scholarworks.umt.edu/cgi/viewcontent.cgi?article=5375&context=etd].
Wang (2015) "Characteristics of horizontal force generation for individuals post-stroke walking against progressive resistive forces", Clin Biomech (Bristol, Avon) 30(1): 40-45.
Wu (2011) "A cable-driven locomotor training system for restoration of gait in human SCI", Gait & Posture 33 (2011) 256-260.

* cited by examiner

FORCE PROFILE CONTROL FOR THE APPLICATION OF HORIZONTAL RESISTIVE FORCE

CROSS-REFERENCE TO RELATED APPLICATION

This application claims priority to and the benefit of the filing date of U.S. Provisional Patent Application No. 62/330,578, filed May 2, 2016, which application is incorporated herein by reference in its entirety.

FIELD

This disclosure relates to systems and methods for controlling the application of horizontal resistive force by a cable, such as a cable that applies horizontal resistive force to a treadmill user.

JOINT RESEARCH AGREEMENT

The presently claimed invention was made by or on behalf of the below listed parties to a joint research agreement. The joint research agreement was in effect on or before the earliest effective filing date of the claimed invention, and the claimed invention was made as a result of activities undertaken within the scope of the joint research agreement. The parties to the joint research agreement are (1) the Board of Trustees of the University of Alabama for the University of Alabama at Birmingham, (2) the UAB Research Foundation, and (3) Southern Research Institute.

BACKGROUND

When individuals walk or run at an average velocity, their instantaneous velocity varies considerably depending upon where the user is within his or her gait cycle. There is a need for improved systems and methods for adjusting and controlling application of a horizontal resistive force applied to individuals (e.g., treadmill users) who are walking or running at an average velocity.

SUMMARY

Described herein, in various aspects, is a system having a cable, a motor, and a system controller. The cable can have a distal end configured to be coupled to a harness to apply a horizontal resistive force to a treadmill user. The motor can be coupled to the cable and configured to apply a motor force to the cable. The cable can have an adjustable operative length corresponding to a distance of cable extending outwardly from the motor toward the harness. The system controller can have a processor communicatively coupled to the motor. The processor can be configured to: receive an input indicative of the position of the cable; determine the operative length of the cable based upon the position of the cable; receive at least one input indicative of an actual force applied by the motor to the cable; determine an average applied motor force based upon the at least one received input indicative of the actual applied force; and selectively adjust the motor force applied by the motor to thereby adjust the average applied motor force and the horizontal resistive force transferred from the harness to the treadmill user. The processor can be configured to increase the average applied motor force when the operative length of the cable exceeds a first predetermined length. The processor can be further configured to decrease the average applied motor force when the operative length of the cable is below a second predetermined length that is less than the first predetermined length. The processor can be further configured to maintain the average applied motor force when the operative length of the cable is between the first and second predetermined lengths.

Also described herein is a system including a treadmill, a harness, a cable, a motor, and a system controller. The treadmill can have at least one support post and a motor housing. The motor housing can be mounted to the at least one support post. The harness can be configured to transfer a horizontal resistive force to a treadmill user. The cable can have a distal end coupled to the harness. The motor can be coupled to the cable and positioned within the motor housing. The motor can be configured to apply a motor force to the cable. The cable can have an adjustable operative length corresponding to a distance of cable extending outwardly from the motor toward the harness. The system controller can have a processor communicatively coupled to the motor. The processor can be configured to: receive an input indicative of the position of the cable; determine the operative length of the cable based upon the position of the cable; receive at least one input indicative of an actual force applied by the motor to the cable; determine an average applied motor force based upon the at least one received input indicative of the actual applied force; and selectively adjust the motor force applied by the motor to thereby adjust the average applied motor force and the horizontal resistive force transferred from the harness to the treadmill user. The processor can be configured to increase the average applied motor force when the operative length of the cable exceeds a first predetermined length. The processor can be further configured to decrease the average applied motor force when the operative length of the cable is below a second predetermined length that is less than the first predetermined length. The processor can be further configured to maintain the average applied motor force when the operative length of the cable is between the first and second predetermined lengths.

Further described herein is a method including transferring a horizontal resistive force to a treadmill user through a harness. The harness can be coupled to a distal end of a cable. The method can further include using a motor to apply a motor force to the cable. The cable can have an adjustable operative length corresponding to a distance of cable extending outwardly from the motor toward the harness. The motor can be communicatively coupled to a processor of a system controller. The method can further include: using the processor to receive an input indicative of the position of a portion of the cable; using the processor to determine the operative length of the cable based upon the received input that is indicative of the position of the portion of the cable; using the processor to receive at least one input indicative of an actual force applied by the motor to the cable; using the processor to determine an average applied motor force based upon the at least one received input that is indicative of the actual applied force; and using the processor to selectively adjust the motor force applied by the motor to thereby adjust the average applied motor force and the horizontal resistive force transferred from the harness to the treadmill user. When the operative length of the cable exceeds a first predetermined length, the processor can increase the average applied motor force. When the operative length of the cable is below a second predetermined length that is less than the first predetermined length, the processor can decrease the average applied motor force. When the operative length of the cable is between the first and second predetermined lengths, the processor can maintain the average applied motor force.

DETAILED DESCRIPTION

Figure 1A:
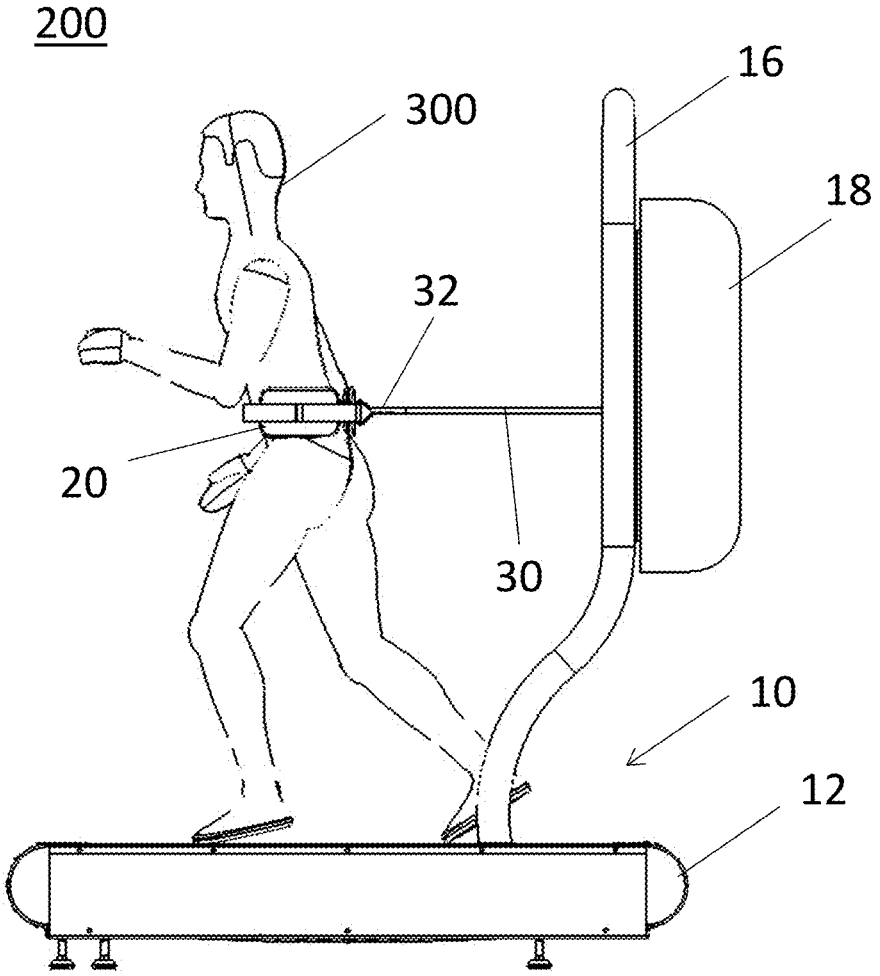
FIG. 1A is a side view showing a user on an exemplary force-induced treadmill. As shown, the user is positioned in an ideal, intermediate region of the treadmill.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" comprise plural referents unless the context clearly dictates otherwise. Thus, for example, reference to "a sensor" can comprise two or more such sensors unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description comprises instances where said event or circumstance occurs and instances where it does not.

As used herein the term "communicatively coupled" refers to any wired or wireless communication arrangement as is known in the art. Such wired or wireless communication can be direct (between two components) or can be indirect (via an intermediate component).

The word "or" as used herein means any one member of a particular list and also comprises any combination of members of that list.

Described herein with reference to FIGS. 1A-5B are systems and methods for controlling the application of horizontal resistive force to an individual (e.g., a treadmill user) 300. In exemplary aspects, the systems and methods can be used to control the application of horizontal resistive force to a user 300 on a treadmill 10 with one or more belts 14.

In exemplary aspects, the disclosed systems and methods can be used in conjunction with a force induced treadmill, which applies a horizontal resistive force to the user's center of mass while the user is walking on a treadmill at a chosen speed. An exemplary force-induced treadmill 10 is depicted in FIG. 1A. Application of predefined resistive forces (by a torque motor 40) requires the user 300 to achieve a specified work rate without changing the speed or inclination of the treadmill belt. The magnitude of the applied force depends on the fitness level of the individual, and the applied forces can exceed 150 lbs. Optionally, in exemplary non-limiting aspects, the disclosed systems and methods can be used in conjunction with the treadmill system disclosed in International Patent Application No. PCT/US15/46666, entitled "System and Method for Performing Exercise Testing and Training," filed Aug. 25, 2015, which is incorporated herein by reference in its entirety.

In exemplary aspects, and with reference to FIGS. 1A-5B, disclosed herein is a system 200 having a cable 30, a motor 40, and a system controller 50. In these aspects, it is contemplated that the cable 30 can comprise an elastic material (e.g., rubber), a rigid material (e.g., steel), or combinations thereof. Optionally, the system 200 can comprise a treadmill 10 having a base portion 12 and a belt 14 that is configured to move cyclically about the base portion of the treadmill. Optionally, the treadmill 10 can comprise at least one support post 16 and a motor housing 18 that is mounted to (or otherwise supports) the at least one support post. In these optional aspects, the at least one support post 16 can extend upwardly from the base portion 12 of the treadmill 10. Optionally, the at least one support post 16 can comprise a support frame. In further aspects, the system 200 can comprise a harness 20 configured to transfer a horizontal resistive force to a treadmill user. In additional aspects, the cable 30 can have a distal end 32 coupled to the harness 20. Optionally, the cable 30 can be coupled to the harness 20 using elastic connectors or fasteners that provide give and flexibility during use of the harness as disclosed herein. The harness can be configured for positioning around a waist area of the user 300. In exemplary aspects, the motor 40 can be coupled to the cable 30 and positioned within the motor housing 18 (when present). In these aspects, the motor 40 can be configured to apply a motor force to the cable 30.

While individuals walk at an average velocity, their instantaneous velocity varies depending on where the user is within his or her gait cycle (e.g. heel strike vs. active propulsion). Applying a constant resistive for to a user (e.g. hanging a weight from the cable) can amplify this variation in instantaneous velocity phenomenon and cause the user to substantially change his or her relative position on the treadmill belt 14 over each phase of the user's gait. Therefore, there is a need for control systems and methods to appropriately regulate the horizontal resistive force applied by a constant torque motor. As further disclosed herein, the torque motor 40 of system 200 can be configured to smoothly change the magnitude of the force applied to the user 300, and to quickly remove the applied force during an emergency situation.

Figure 1B:
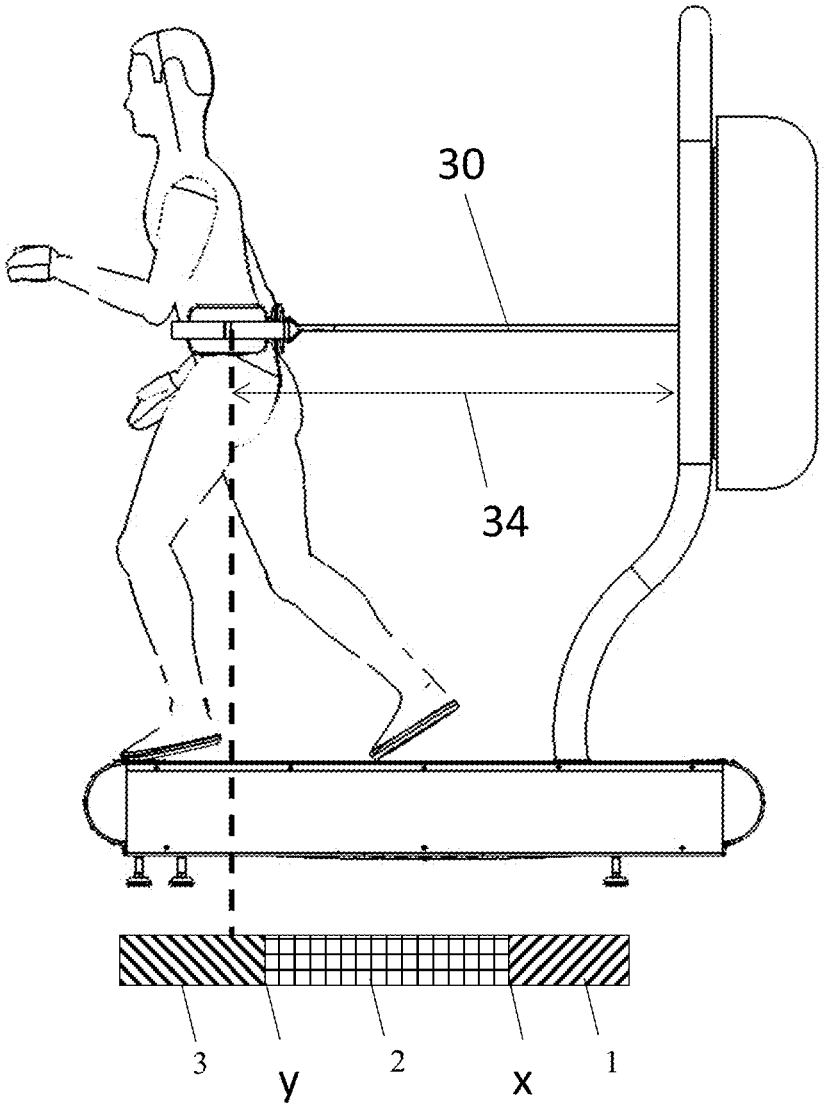
FIG. 1B depicts the user in a third region (region 3) of the treadmill past the ideal, intermediate region (labeled as region 2).
Figure 1C:
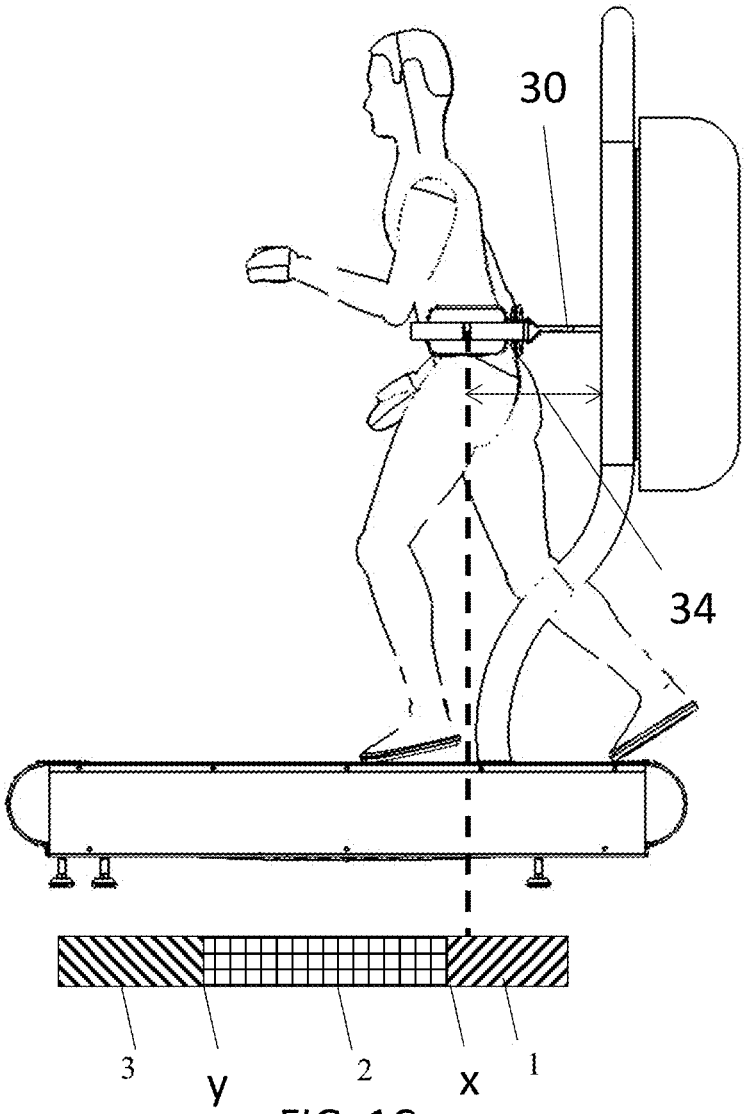
FIG. 1C depicts the user in a first region (region 1) of the treadmill before reaching the ideal, intermediate region (region 2).
Figure 2:
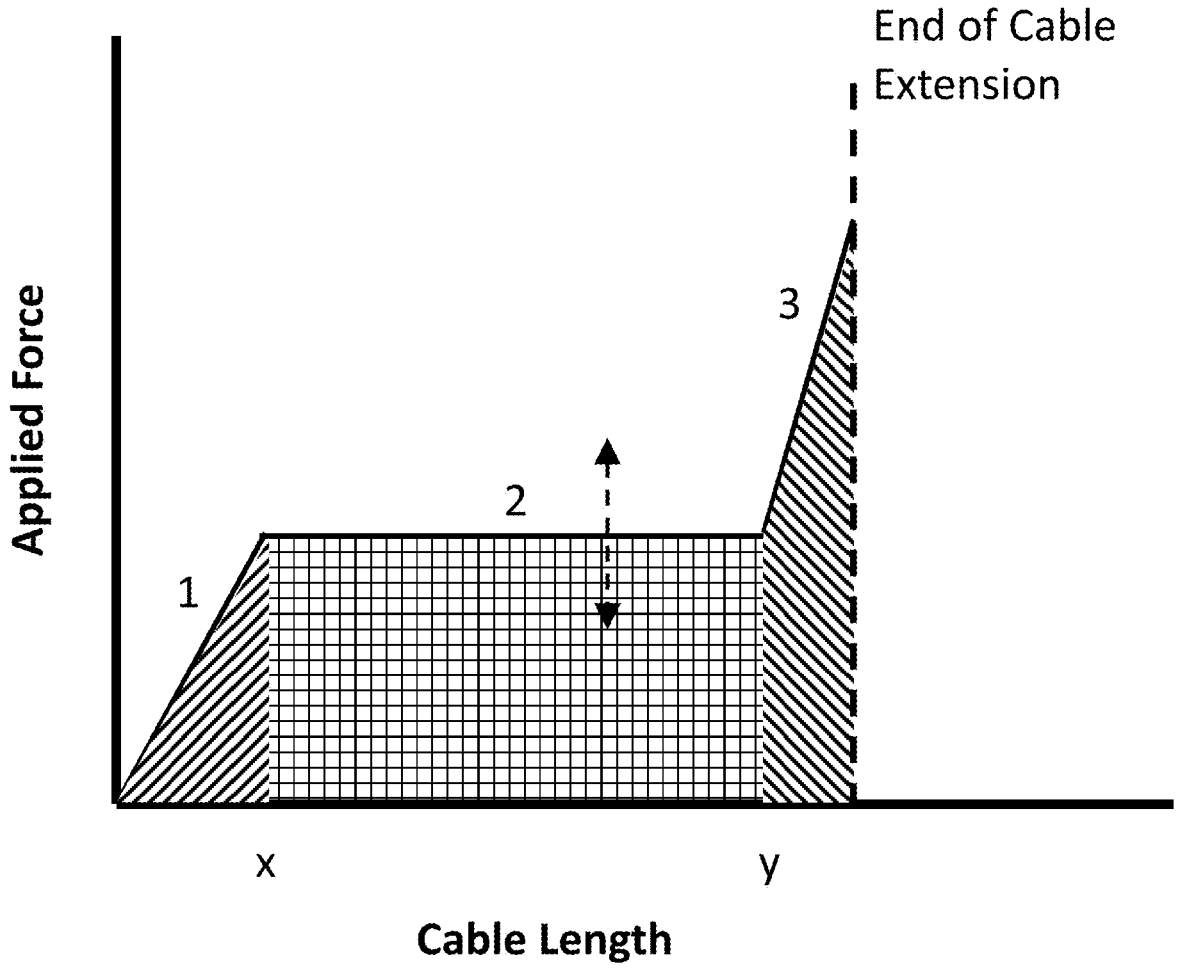
FIG. 2 is a graph depicting the relationship between applied force and cable length in accordance with the disclosed systems and methods for controlling application of resistive force.

For a motor to apply resistance, the cable 30 must be under tension. Also, a treadmill walking surface is finite in length—if too much cable is let out, the user will walk off the front of the treadmill belt or, alternatively, the user can be pinned to the rear housing unit if too much cable is taken in due to applied forces. Therefore, there is an ideal intermediate region 2 (see FIGS. 1B-1C) on the treadmill belt that the user should stay within. In exemplary aspects, region 2 can correspond to the region between positions 'x' and 'y' as further disclosed herein. A force profile under closed loop control showing three regions of interest 1, 2, 3 is depicted in FIGS. 1B-2. It is contemplated that the cable 30 can have an adjustable operative length 34 corresponding to a distance of cable extending outwardly from the motor 40 or motor housing 18 toward the harness 20. As an example, the distance between position 'x' and the motor housing 18 can be about 6 inches (about 0.15 m), and the distance between position 'y' and the motor housing can be about 30 inches (0.76 m).

As shown in FIG. 2, when the cable is fully retracted towards the motor, zero force is applied to the cable. As the cable is pulled away from the motor through position 'x', the applied force is increased toward the final commanded force as a function of cable position in a spring-like function. In addition to being a safety feature to prevent the motor from pinning someone to the rear housing unit, the application of increasing force as the user advances forward (toward position 'x') allows for a smooth application of force. The relation describing the change of force application with cable position may be described by any mathematical equation, but is preferentially described by a linear, quadratic, or a higher ordered equation.

Figure 3A:
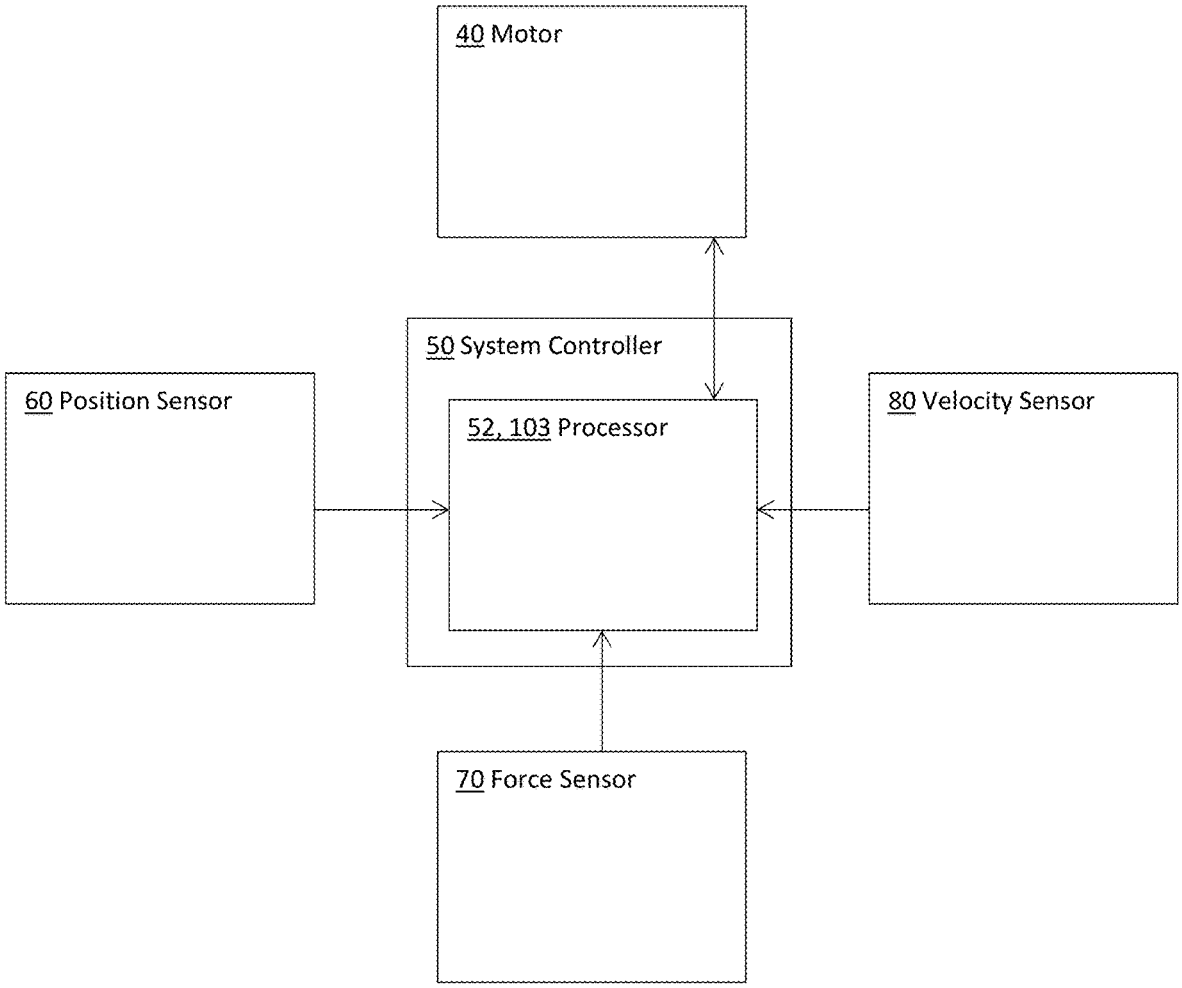
FIG. 3A is a schematic diagram depicting communication between the system controller, the motor, and the sensors of an exemplary system as disclosed herein.
Figure 3B:
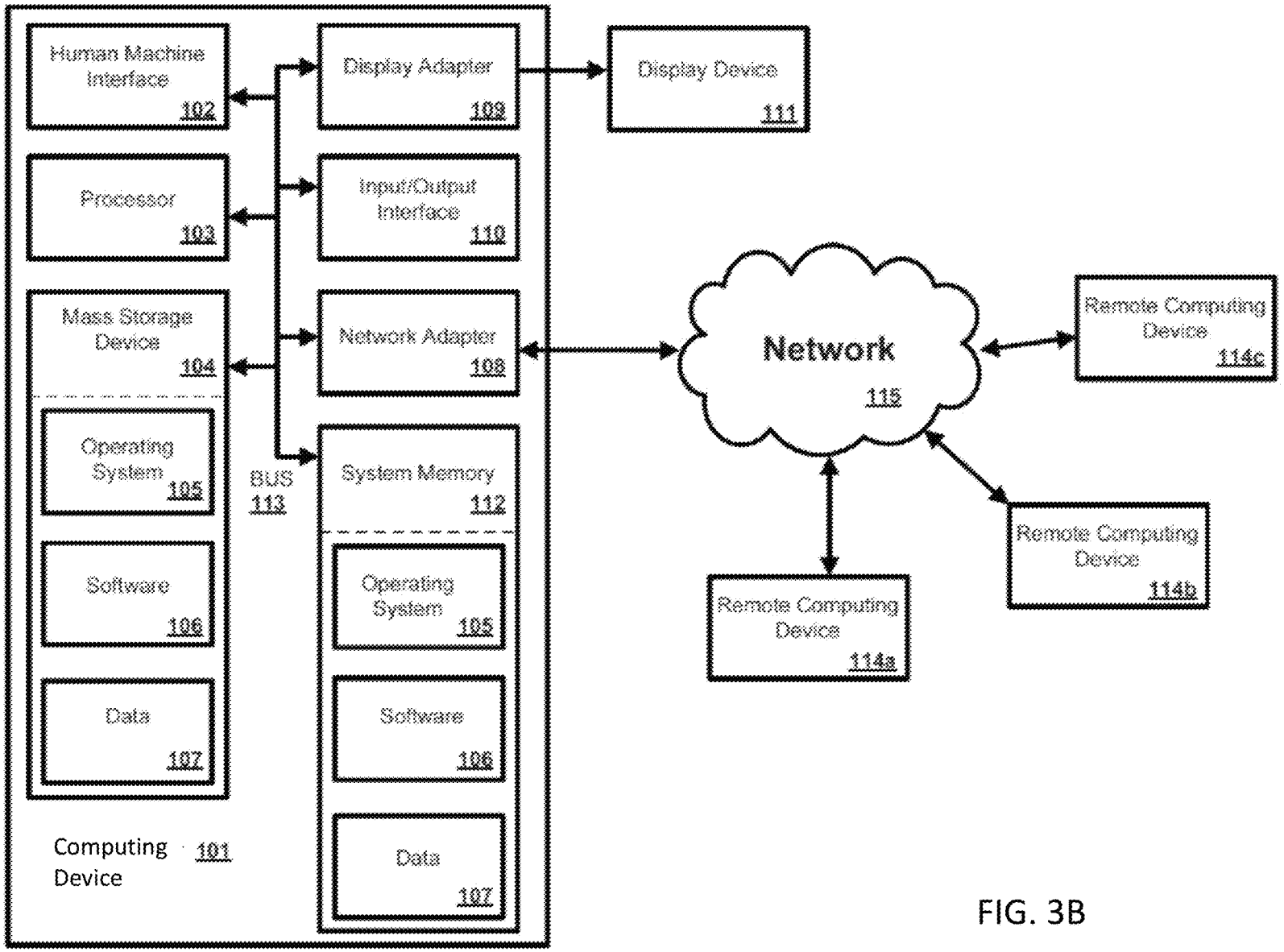
FIG. 3B is a schematic diagram depicting an exemplary computing device that can serve as a system controller as disclosed herein.

With reference to FIGS. 2-3B, when the cable 30 is pulled away from the motor 40 between positions 'x' and 'y', the resistive forces are controlled with a closed loop force controller 50 to keep the average applied force constant (or within a desired range) regardless of cable position (relative to the length of the treadmill). The relationship between applied force and cable position may be described by any mathematical equation, but is preferentially described by a linear equation with a slope approximately equal to zero. The magnitude of the constant force applied in this region 2 may be adjusted depending on the fitness of the user, the walking speed of the user, the exercise protocol being followed, physiological feedback (e.g. heart rate), and/or other parameters. Also, as varying forces are commanded, the forces can be low-pass filtered using conventional data processing methods to prevent sudden or jerky transitions.

As shown in FIG. 2, once the cable position exceeds position 'y' (and the distal end of the cable is positioned within region 3), the controlled applied force increases as a function of cable position. The increasing force as a function of cable position in this region is to prevent the user from walking off the end of the treadmill (See FIG. 1B). The relationship between applied force and cable position may be described by any mathematical equation, but is preferentially described by a linear, quadratic, or a higher ordered equation.

The equations describing the application of force versus cable position in the first and third regions (regions 1 and 3, on opposite sides of the ideal, intermediate region (region 2) between positions 'x' and 'y') may be the same or different.

In further exemplary aspects, the system 200 can comprise a system controller 50 having a processor 52 (103) communicatively coupled to the motor 40. In these aspects, the processor 52 can be configured to: receive an input indicative of the position of the cable; determine the operative length of the cable based upon the position of the cable; receive at least one input indicative of an actual force applied by the motor to the cable; determine an average applied motor force based upon the at least one received input indicative of the actual applied force; and selectively adjust the motor force applied by the motor to thereby adjust the average applied motor force and the horizontal resistive force transferred from the harness to the treadmill user. In further exemplary aspects, the processor 52 (103) can be configured to increase the average applied motor force when the operative length of the cable exceeds a first predetermined length. In these aspects the processor 52, 103 can be configured to decrease the average applied motor force when the operative length of the cable is below a second predetermined length that is less than the first predetermined length. In still further aspects, the processor 52 (103) can be configured to maintain the average applied motor force when the operative length of the cable is between the first and second predetermined lengths (between positions 'x' and 'y').

As shown in FIGS. 3A-4C, the control system that produces this force profile can be a closed loop control system. Under normal operation, a controller 50 commands the motor via servo control to apply a specified force to the cable 30. The user works against the applied force by walking on the treadmill belt. A force sensor 70 positioned in line with the cable 30 can record and provide feedback of the actual force between the motor 40 and the user 300. If the motor 40 is not applying enough force to the user (based upon the determined average applied force over a selected period of time), the cable (and user) position can move forward (toward position 'y'), and a comparator and/or controller can command the motor 40 to increase the motor force as the user enters the third region (region 3) of the force profile (See FIGS. 1B and 2). In use, the comparator can be configured to compare the actual applied force to the specified force to be applied according to the programmed force profile. Optionally, the comparator can be provided as a component of the circuitry of the controller 50. Alternatively, it is contemplated that the comparator can be provided as processing circuitry that is separate from the controller. If the motor is applying too much force to the user (based upon the determined average applied force over a selected period of time), the cable (and user) position can be moved backward and the comparator and controller can command the motor to decrease the motor force as the user enters the first region (region 1) of the force profile (See FIGS. 1C and 2). If the cable (and user) position remain within the second, ideal region (region 2) of the force profile, the closed loop servo control maintains the specified force even though there may be changes in cable position within the second region (region 2).

If a fault occurs, such as the user falling, the in-line force sensor 70 detects the measured force between the user and the motor is significantly less than the commanded force, and the control loop switches from a force-controlled to a velocity-controlled system as a safety feature to prevent the cable from being retracted under high forces. The velocity controlled loop slowly pulls the cable back to its 'zero' position (which occurs when no force is applied to the cable to move the cable away from the motor 40 (and the motor housing 18)). The velocity control loop can be programmable to a desired velocity range, including for example and without limitation, from about 0.1 mph to about 3.0 mph (e.g. from about 0.04 to about 1.3 m/s) and, more preferably, from about 0.5 mph to about 2.0 mph (e.g., from about 0.2 to about 0.9 m/s).

In further exemplary aspects, the system 200 can further comprise a position sensor 60 communicatively coupled to the processor. In these aspects, the position sensor 60 can be configured to determine a position of a portion of the cable. In other aspects, it is further completed that the position sensor 60 can be configured to provide the input to the processor 52, 103 that is indicative of the position of the cable 30. Optionally, in exemplary aspects, the position sensor 60 can be coupled or secured (e.g., mounted) to the distal end 32 of the cable 30 and configured to measure an axial position of the distal end of the cable relative to the motor (or the "zero" position of the cable as disclosed herein). Optionally, in other exemplary aspects, the position sensor 60 can be coupled or secured in-line with the motor 40 such that the output of the motor can be correlated to an axial translation of the distal end 32 of the cable 30 relative to the motor. In one exemplary aspect, the position sensor can comprise a geared potentiometer having a gear positioned in-line with the motor. In these aspects, it is contemplated that rotation of the gear of the potentiometer (in response to the force applied by the motor) can correspond to an axial translation of the cable, and the output of the potentiometer can be correlated to the axial position of the distal end of the cable. Other contemplated examples of the position sensor 60 include a non-contact sensor, a capacitive transducer, a capacitive displacement sensor, a linear variable differential transformer (LVDT), a displacement transducer, a piezoelectric transducer, a proximity sensor, a linear encoder, a rotary encoder, a string potentiometer, and the like. Optionally, in exemplary aspects, the motor 40 of the system 200 can comprise a servo motor.

In further exemplary aspects, the system 200 can further comprise a force sensor 70 positioned in-line with the cable 30 such that the force sensor 70 is capable of producing an output indicative of the actual force that is transmitted from the motor to the treadmill user through the cable. In these aspects, the force sensor 70 can be configured to measure the actual force applied between the motor and the treadmill user, and the force sensor can be configured to provide the at least one input to the processor that is indicative of the actual applied force. Any suitable force sensor known in the art can be used. Contemplated examples of the force sensor 70 include a load cell (e.g., a strain gauge load cell, a piezoelectric load cell, a hydraulic load cell, a pneumatic load cell, and the like), a force-sensitive resistor, a pressure sensor, a torque sensor, a density sensor, and the like.

In still further aspects, the processor 52 of the system 200 can be configured to receive an input indicative of a velocity of the cable. Optionally, in still further aspects, the system 200 further comprises a velocity sensor 80 positioned in-line with the cable. In these aspects, the velocity sensor 80 can be configured to measure the velocity of the cable. In operation, it is contemplated that the processor 52, 103 can be configured to decrease the motor force applied by the cable when the processor detects a velocity of the cable that exceeds a threshold velocity. In exemplary aspects, the velocity sensor 80 can be positioned (e.g., secured or mounted) within the motor housing 18. Alternatively, it is contemplated that the velocity sensor 80 can be provided separately from the motor and motor housing. For example, in some aspects, the velocity sensor 80 can be provided as a tachometer or other velocity sensor that is positioned outside the motor housing 18. In still other aspects, when the position sensor is present and functioning, it is contemplated that the velocity sensor can be omitted, and the processor 52 can be configured to determine the velocity of the cable by calculating the derivative of the output produced by the position sensor 60.

Optionally, in exemplary aspects, the motor housing 18 can define an opening 19. In these aspects, and as shown in FIGS. 1A-1C and 5A-5B, the cable can extend through the opening 19 of the motor housing 18 such that the distal end 32 of the cable 30 is positioned external to the motor housing 18. In exemplary aspects, the opening 19 can be sufficiently thin or narrow that the harness (or distal portion of the cable) is incapable of entering the motor housing 18. In these aspects, it is contemplated that the opening 19 can also be shaped to minimize or eliminate the risk of a portion of a body of a user entering the motor housing 18.

Figure 4A:
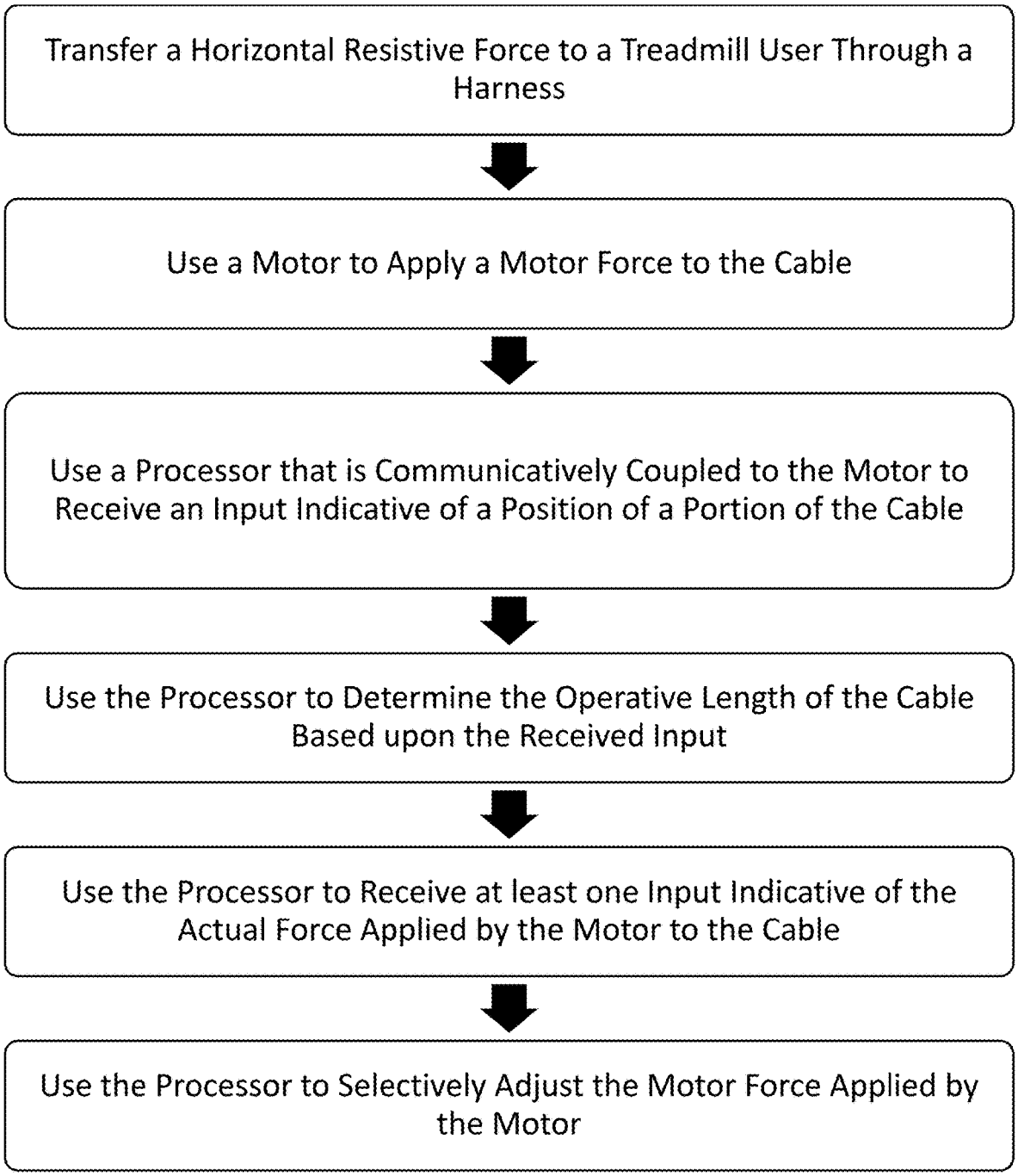
FIG. 4A is a flowchart schematically depicting an exemplary method for controlling application of resistive force as disclosed herein.
Figure 4B:
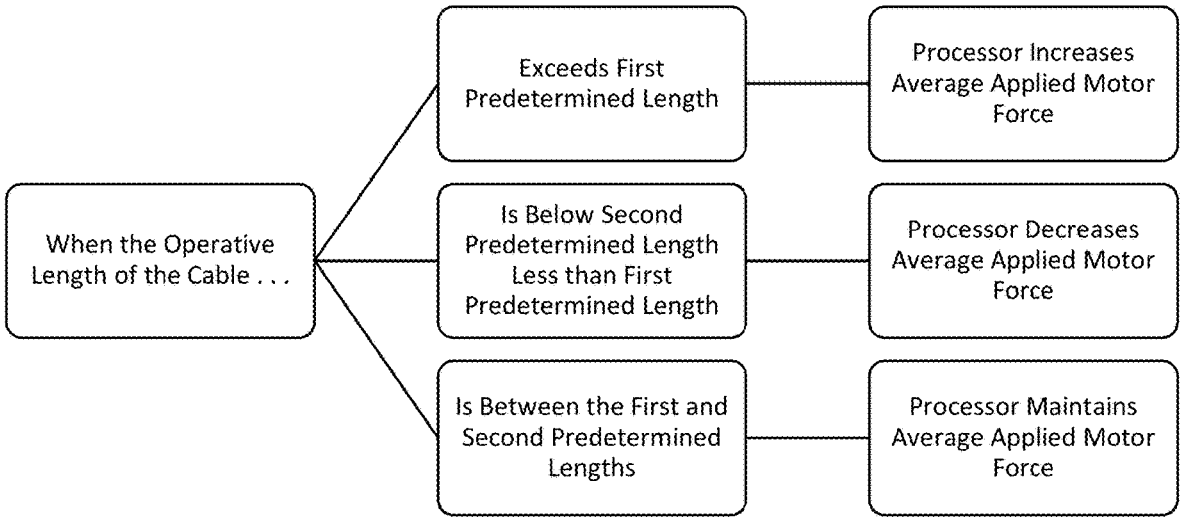
FIG. 4B is a flowchart schematically depicting the adjustment of the application of motor force to a user as disclosed herein.
Figure 4C:
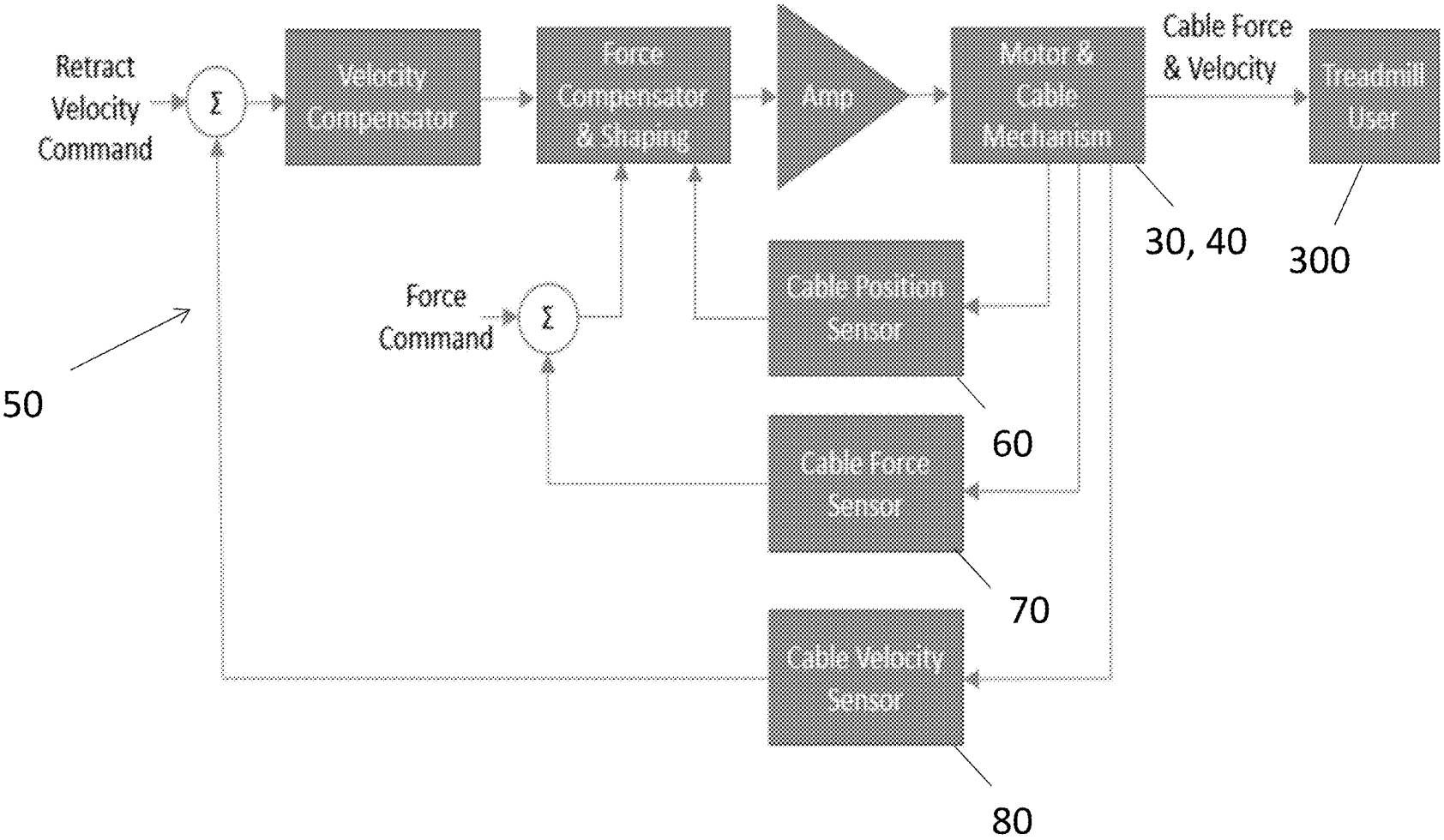
FIG. 4C is a flowchart schematically depicting the communication between the components of an exemplary system for controlling application of resistive force as disclosed herein.
Figure 5A:
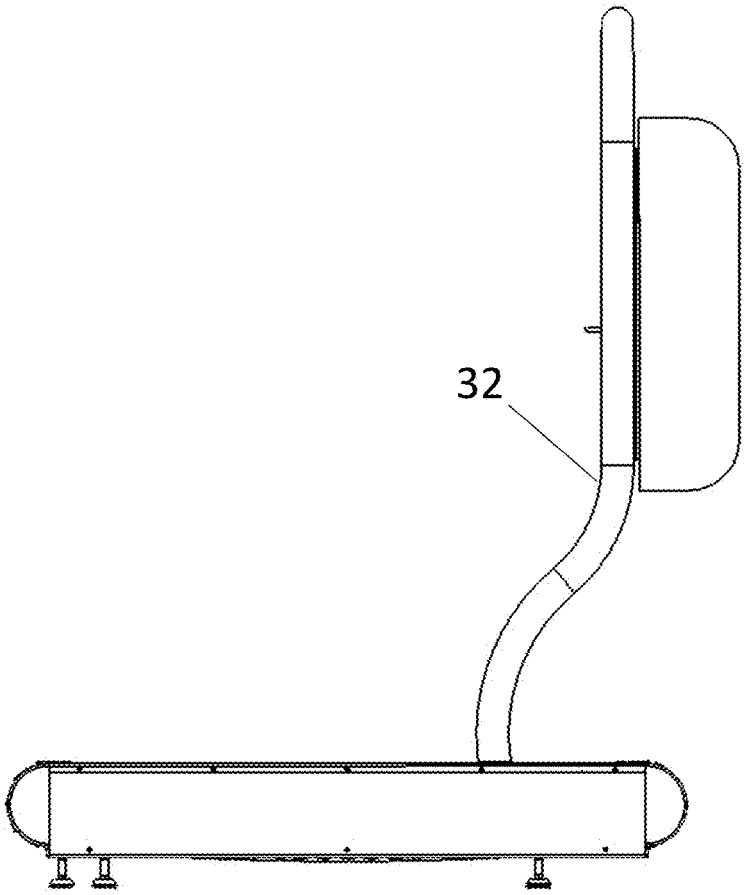
FIG. 5A is a side view of a treadmill having a cable positioned in a zero (starting) position.
Figure 5B:
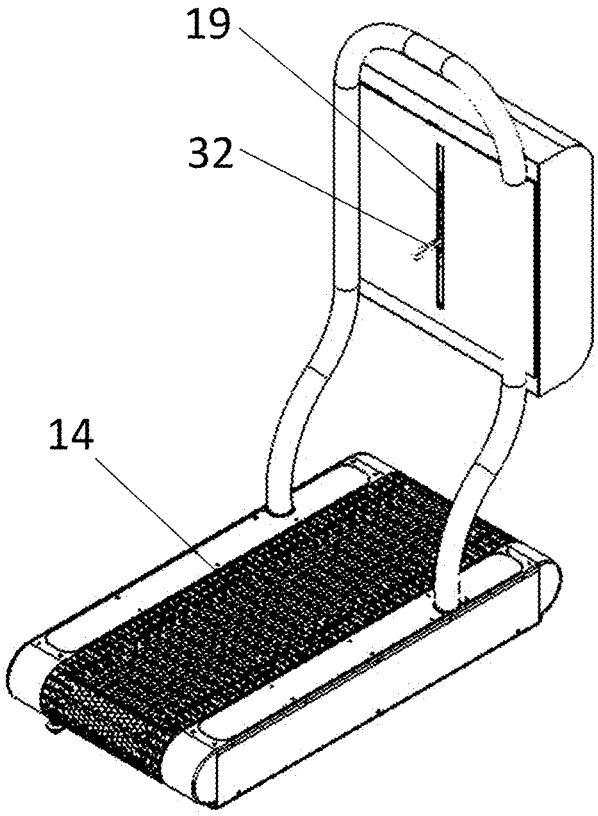
FIG. 5B is a front perspective view of the treadmill of FIG. 5A.

In use, and with reference to FIGS. 4A-4C, the disclosed system 200 can be used in a method comprising transferring a horizontal resistive force to a treadmill user through a harness. In one aspect, the harness can be coupled to the distal end of the cable. In another aspect, the method can further comprise using the motor to apply a motor force to the cable. In this aspect, the cable can have an adjustable operative length corresponding to a distance of cable extending outwardly from the motor toward the harness. It is further contemplated that the motor can be communicatively coupled to the processor of the system controller. In an additional aspect, the method can further comprise using the processor to receive an input indicative of the position of a portion of the cable. In a further aspect, the method can comprise using the processor to determine the operative length of the cable based upon the received input that is indicative of the position of the portion of the cable. In still another aspect, the method can comprise using the processor to receive at least one input indicative of an actual force applied by the motor to the cable. In still a further aspect, the method can comprise using the processor to determine an average applied motor force based upon the at least one received input that is indicative of the actual applied force. In still a further aspect, the method can comprise using the processor to selectively adjust the motor force applied by the motor to thereby adjust the average applied motor force and the horizontal resistive force transferred from the harness to the treadmill user. When the operative length of the cable exceeds a first predetermined length, the processor can increase the average applied motor force. When the operative length of the cable is below a second predetermined length less than the first predetermined length, the processor can decrease the average applied motor force. When the operative length of the cable is between the first and second predetermined lengths (between the "x" and "y" positions, the processor can maintain the average applied motor force.

In additional exemplary aspects, the method can further comprise using a position sensor to detect the position of a portion of the cable. In these aspects, the position sensor can be communicatively coupled to the processor. The position sensor can be configured to transmit, to the processor, an output indicative of the position of the cable.

In another aspect, the method can further comprise using a force sensor positioned in-line with the cable to measure the actual force applied between the motor and the treadmill user. In this aspect, the method can further comprise using the force sensor to transmit, to the processor, an output indicative of the actual applied force.

In an additional aspect, the method can further comprise using the processor to receive an input indicative of a velocity of the cable. Optionally, in this aspect, the method can comprise using a velocity sensor positioned in-line with the cable to measure the velocity of the cable. The method can further comprise using the velocity sensor to transmit, to the processor, an output indicative of the velocity of the cable.

In a further aspect, the method can further comprise using the processor to decrease the motor force applied by the cable when the processor detects a velocity of the cable that exceeds a threshold velocity.

Although disclosed herein with reference to the control of horizontal resistive force to a treadmill user, it is contemplated that the disclosed force profile control systems and methods can be used in other applications, including, for example and without limitation, other electronically controlled exercise mechanisms, and, more generally, any mechanism which controls force on a cable, such as the cables utilized with a military towed airborne target or towed sonar array.

As will be appreciated by one skilled in the art, the disclosed devices, methods, and systems may take the form of an entirely hardware embodiment, an entirely software embodiment, or an embodiment combining software and hardware aspects. Furthermore, the methods and systems may take the form of a computer program product on a computer-readable storage medium having computer-readable program instructions (e.g., computer software) embodied in the storage medium. More particularly, the present methods and systems may take the form of web-implemented computer software. Any suitable computer-readable storage medium may be utilized including hard disks, CD-ROMs, optical storage devices, or magnetic storage devices.

Embodiments of the methods and systems are described below with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

One skilled in the art will appreciate that provided herein is a functional description and that the respective functions can be performed by software, hardware, or a combination of software and hardware. In an exemplary aspect, the methods and systems can be implemented, at least in part, on a computing device 101 as illustrated in FIG. 3B and described below. By way of example, the processor 52, 103 described herein can be part of a computing device 101 as illustrated in FIG. 3B. Similarly, the methods and systems disclosed can utilize one or more computing devices (e.g., computers, smartphones, or tablets) to perform one or more functions in one or more locations.

FIG. 3B is a block diagram illustrating an exemplary operating environment for performing at least a portion of the disclosed methods. This exemplary operating environment is only an example of an operating environment and is not intended to suggest any limitation as to the scope of use or functionality of operating environment architecture. Neither should the operating environment be interpreted as having any dependency or requirement relating to any one or combination of components illustrated in the exemplary operating environment.

The present methods and systems can be operational with numerous other general purpose or special purpose computing system environments or configurations. Examples of well-known computing systems, environments, and/or configurations that can be suitable for use with the systems and methods comprise, but are not limited to, personal computers, server computers, laptop devices, and multiprocessor systems. Additional examples comprise set top boxes, programmable consumer electronics, network PCs, minicomputers, mainframe computers, distributed computing environments that comprise any of the above systems or devices, and the like.

The processing of the disclosed methods and systems can be performed by software components. The disclosed systems and methods can be described in the general context of computer-executable instructions, such as program modules, being executed by one or more computers or other devices. Generally, program modules comprise computer code, routines, programs, objects, components, data structures, etc., that perform particular tasks or implement particular abstract data types. The disclosed methods can also be practiced in grid-based and distributed computing environments where tasks are performed by remote processing devices that are linked through a communications network. In a distributed computing environment, program modules can be located in both local and remote computer storage media including memory storage devices.

Further, one skilled in the art will appreciate that the systems and methods disclosed herein can be implemented via a general-purpose computing device in the form of a computing device 101. The components of the computing device 101 can comprise, but are not limited to, one or more processors or processing units 103, a system memory 112, and a system bus 113 that couples various system components including the processor 103 to the system memory 112. In the case of multiple processing units 103, the system can utilize parallel computing.

The system bus 113 represents one or more of several possible types of bus structures, including a memory bus or memory controller, a peripheral bus, an accelerated graphics port, and a processor or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus 113, and all buses specified in this description can also be implemented over a wired or wireless network connection and each of the subsystems, including the processor 103, a mass storage device 104, an operating system 105, control processing software 106, control processing data 107, a network adapter 108, system memory 112, an Input/Output Interface 110, a display adapter 109, a display device 111, and a human machine interface 102, can be contained within one or more remote computing devices 114*a,b,c* at physically separate locations, connected through buses of this form, in effect implementing a fully distributed system.

The computing device 101 typically comprises a variety of computer readable media. Exemplary readable media can be any available media that is accessible by the computing device 101 and comprises, for example and not meant to be limiting, both volatile and non-volatile media, removable and non-removable media. The system memory 112 comprises computer readable media in the form of volatile memory, such as random access memory (RAM), and/or non-volatile memory, such as read only memory (ROM). The system memory 112 typically contains data such as control processing data 107 and/or program modules such as operating system 105 and control processing software 106 that are immediately accessible to and/or are presently operated on by the processing unit 103.

In another aspect, the computing device 101 can also comprise other removable/non-removable, volatile/non-volatile computer storage media. By way of example, a mass storage device 104 can provide non-volatile storage of computer code, computer readable instructions, data structures, program modules, and other data for the computing device 101. For example and not meant to be limiting, a mass storage device 104 can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device 104, including by way of example, an operating system 105 and control processing software 106. Each of the operating system 105 and control processing software 106 (or some combination thereof) can comprise elements of the programming and the control processing software 106. Control processing data 107 can also be stored on the mass storage device 104. Control processing data 107 can be stored in any of one or more databases known in the art. Examples of such databases comprise, DB2®, Microsoft® Access, Microsoft® SQL Server, Oracle®, mySQL, PostgreSQL, and the like. The databases can be centralized or distributed across multiple systems.

In another aspect, the user can enter commands and information into the computing device 101 via an input device, such as, without limitation, a keyboard, pointing device (e.g., a "mouse"), a microphone, a joystick, a scanner, tactile input devices such as gloves, and other body coverings, and the like. These and other input devices can be connected to the processing unit 103 via a human machine interface that is coupled to the system bus 113, but can be connected by other interface and bus structures, such as a parallel port, game port, an IEEE 1394 Port (also known as a Firewire port), a serial port, a universal serial bus (USB), or an Intel® Thunderbolt.

Optionally, in exemplary aspects, the processor 52, 103 of the controller 50 disclosed herein can receive manual inputs from a user or other individual supervising the application of horizontal resistive force to the user. Such manual inputs can correspond to a desired walking/running speed of the user, an exercise protocol being followed, measurements of the 'x' and 'y' distances disclosed herein, a desired range of maximum and minimum applied forces, and patient information (physical condition, age, weight, and the like). It is further contemplated that the processor 52, 103 can be communicatively coupled to other components, such as a heart rate monitor or other monitoring device that provides physiological feedback (e.g. heart rate) or other parameter measurements to the processor 52, 103. It is still further contemplated that the processor 52, 103 can be communicatively coupled to a memory as further disclosed herein that stores a pre-set profile corresponding to the user. In operation, the processor 52, 103 can make use of these instructions to provide a customized force application profile for the user and ensure that any adjustments to the application of horizontal resistive force are consistent with the instructions.

In yet another aspect, the display device 111 can also be connected to the system bus 113 via an interface, such as a display adapter 109. It is contemplated that the computing device 101 can have more than one display adapter 109 and the computing device 101 can have more than one display device 111. For example, a display device can be a monitor, an LCD (Liquid Crystal Display), an OLED (Organic Light Emitting Diode), or a projector. In addition to the display device 111, other output peripheral devices can comprise components such as speakers (not shown) and a printer (not shown) which can be connected to the computing device 101 via Input/Output Interface 110. Any step and/or result of the methods can be output in any form to an output device. Such output can be any form of visual representation, including, but not limited to, textual, graphical, animation, audio, tactile, and the like. The display 111 and computing device 101 can be part of one device, or separate devices.

The computing device 101 can operate in a networked environment using logical connections to one or more remote computing devices 114*a,b,c*. By way of example, a remote computing device can be a personal computer, portable computer, smartphone, a tablet, a server, a router, a network computer, a peer device or other common network node, and so on. In exemplary aspects, a remote computing device can be operated by a therapist as disclosed herein. Logical connections between the computing device 101 and a remote computing device 114*a,b,c* can be made via a network 115, such as a local area network (LAN) and/or a general wide area network (WAN). Such network connections can be through a network adapter 108. A network adapter 108 can be implemented in both wired and wireless environments. Such networking environments are conventional and commonplace in dwellings, offices, enterprise-wide computer networks, intranets, and the Internet.

For purposes of illustration, application programs and other executable program components such as the operating system 105 are illustrated herein as discrete blocks, although it is recognized that such programs and components reside at various times in different storage components of the computing device 101, and are executed by the data processor(s) of the computer. An implementation of control processing software 106 can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer readable media can comprise "computer storage media" and "communications media." "Computer storage media" comprise volatile and non-volatile, removable and non-removable media implemented in any methods or technology for storage of information such as computer readable instructions, data structures, program modules, or other data. Exemplary computer storage media comprises, but is not limited to, RAM, ROM, EEPROM, solid state, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The methods and systems can employ Artificial Intelligence techniques such as machine learning and iterative learning. Examples of such techniques include, but are not limited to, expert systems, case based reasoning, Bayesian networks, behavior based AI, neural networks, fuzzy systems, evolutionary computation (e.g. genetic algorithms), swarm intelligence (e.g. ant algorithms), and hybrid intelligent systems (e.g. Expert inference rules generated through a neural network or production rules from statistical learning).

The above-described system components may be local to one of the devices (e.g., a computing device, such as a tablet or smartphone) or remote (e.g. servers in a remote data center, or "the cloud"). In exemplary aspects, it is contemplated that many of the system components can be provided in a "cloud" configuration.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A system comprising: a cable having a distal end configured to be coupled to a harness to apply a horizontal resistive force to a treadmill user; a motor coupled to the cable and configured to apply a motor force to the cable, wherein the cable has an adjustable operative length corresponding to a distance of cable extending outwardly from the motor toward the harness; and a system controller comprising a processor communicatively coupled to the motor, wherein the processor is configured to: receive an input indicative of the position of the cable; determine the operative length of the cable based upon the position of the cable; receive at least one input indicative of an actual force applied by the motor to the cable; determine an average applied motor force based upon the at least one received input indicative of the actual applied force; and selectively adjust the motor force applied by the motor to thereby adjust the average applied motor force and the horizontal resistive force transferred from the harness to the treadmill user, wherein the processor is configured to increase the average applied motor force when the operative length of the cable exceeds a first predetermined length, and wherein the processor is configured to decrease the average applied motor force when the operative length of the cable is below a second predetermined length that is less than the first predetermined length, and wherein the processor is configured to maintain the average applied motor force when the operative length of the cable is between the first and second predetermined lengths.

Aspect 2: The system of aspect 1, further comprising a position sensor communicatively coupled to the processor, wherein the position sensor is configured to determine a position of a portion of the cable, and wherein the position sensor is configured to provide the input to the processor that is indicative of the position of the cable.

Aspect 3: The system of aspect 1 or aspect 2, wherein the motor is a servo motor.

Aspect 4: The system of any one of the preceding aspects, further comprising a force sensor positioned in-line with the cable, wherein the force sensor is configured to measure the actual force applied between the motor and the treadmill user, and wherein the force sensor is configured to provide the at least one input to the processor that is indicative of the actual applied force.

Aspect 5: The system of any one of the preceding aspects, wherein the processor is configured to receive an input indicative of a velocity of the cable.

Aspect 6: The system of aspect 5, further comprising a velocity sensor positioned in-line with the cable, wherein the velocity sensor is configured to measure the velocity of the cable.

Aspect 7: The system of aspect 5 or aspect 6, wherein the processor is configured to decrease the motor force applied by the cable when the processor detects a velocity of the cable that exceeds a threshold velocity.

Aspect 8: The system of any one of the preceding aspects, further comprising a treadmill.

Aspect 9: The system of aspect 8, wherein the treadmill comprises at least one support post and a motor housing, wherein the motor housing is mounted to the at least one support post, and wherein the motor is positioned within the motor housing.

Aspect 10: The system of aspect 9, wherein the motor housing defines an opening, and wherein the cable extends through the opening of the motor housing such that the distal end of the motor housing is positioned external to the motor housing.

Aspect 11: The system of aspect 9 or aspect 10, further comprising a harness configured to transfer a horizontal resistive force to a treadmill user, wherein the harness is coupled to the distal end of the cable.

Aspect 12: A system comprising: a treadmill comprising at least one support post and a motor housing, wherein the motor housing is mounted to the at least one support post; a harness configured to transfer a horizontal resistive force to a treadmill user; a cable having a distal end coupled to the harness; a motor coupled to the cable and positioned within the motor housing, wherein the motor is configured to apply a motor force to the cable, wherein the cable has an adjustable operative length corresponding to a distance of cable extending outwardly from the motor toward the harness; and a system controller comprising a processor communicatively coupled to the motor, wherein the processor is configured to: receive an input indicative of the position of the cable; determine the operative length of the cable based upon the position of the cable; receive at least one input indicative of an actual force applied by the motor to the cable; determine an average applied motor force based upon the at least one received input indicative of the actual applied force; and selectively adjust the motor force applied by the motor to thereby adjust the average applied motor force and the horizontal resistive force transferred from the harness to the treadmill user, wherein the processor is configured to increase the average applied motor force when the operative length of the cable exceeds a first predetermined length, and wherein the processor is configured to decrease the average applied motor force when the operative length of the cable is below a second predetermined length that is less than the first predetermined length, and wherein the processor is configured to maintain the average applied motor force when the operative length of the cable is between the first and second predetermined lengths.

Aspect 13: The system of aspect 12, further comprising a position sensor communicatively coupled to the processor, wherein the position sensor is configured to determine a position of a portion of the cable, and wherein the position sensor is configured to provide the input to the processor that is indicative of the position of the cable.

Aspect 14: The system of any one of aspects 12-13, further comprising a force sensor positioned in-line with the cable, wherein the force sensor is configured to measure the actual force applied between the motor and the treadmill user, and wherein the force sensor is configured to provide the at least one input to the processor that is indicative of the actual applied force.

Aspect 15: A method comprising: transferring a horizontal resistive force to a treadmill user through a harness, wherein the harness is coupled to a distal end of a cable; using a motor to apply a motor force to the cable, wherein the cable has an adjustable operative length corresponding to a distance of cable extending outwardly from the motor toward the harness, and wherein the motor is communicatively coupled to a processor of a system controller; using the processor to receive an input indicative of the position of a portion of the cable; using the processor to determine the operative length of the cable based upon the received input that is indicative of the position of the portion of the cable; using the processor to receive at least one input indicative of an actual force applied by the motor to the cable; using the processor to determine an average applied motor force based upon the at least one received input that is indicative of the actual applied force; and using the processor to selectively adjust the motor force applied by the motor to thereby adjust the average applied motor force and the horizontal resistive force transferred from the harness to the treadmill user, wherein: when the operative length of the cable exceeds a first predetermined length, the processor increases the average applied motor force; when the operative length of the cable is below a second predetermined length less than the first predetermined length, the processor decreases the average applied motor force; and when the operative length of the cable is between the first and second predetermined lengths, the processor maintains the average applied motor force.

Aspect 16: The method of aspect 15, further comprising: using a position sensor to detect the position of a portion of the cable, wherein the position sensor is communicatively coupled to the processor; and using the position sensor to transmit, to the processor, an output indicative of the position of the cable.

Aspect 17: The method of claim 15 or claim 16, further comprising: using a force sensor positioned in-line with the cable to measure the actual force applied between the motor and the treadmill user; and using the force sensor to transmit, to the processor, an output indicative of the actual applied force.

Aspect 18: The method of any one of aspects 15-17, further comprising using the processor to receive an input indicative of a velocity of the cable.

Aspect 19: The method of aspect 18, further comprising: using a velocity sensor positioned in-line with the cable to measure the velocity of the cable; and using the velocity sensor to transmit, to the processor, an output indicative of the velocity of the cable.

Aspect 20: The method of aspect 19, further comprising using the processor to decrease the motor force applied by the cable when the processor detects a velocity of the cable that exceeds a threshold velocity.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be comprised within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A system comprising:

a harness configured to transfer a horizontal resistive force to a waist of a treadmill user walking in a single direction on a treadmill;

a cable having a distal end coupled to the harness;

a motor coupled to the cable and configured to apply a motor force to the cable, wherein the cable has an adjustable operative length corresponding to a distance of cable extending outwardly from the motor toward the harness, wherein the cable is configured to transfer the motor force to the harness which in turn transfers the horizontal resistive force to the waist of the treadmill user walking in the single direction; and a system controller comprising a processor communicatively coupled to the motor, wherein the processor is configured to:

receive an input indicative of a translation of the distal end of the cable relative to the motor;

determine the operative length of the cable based upon the translation of the distal end of the cable relative to the motor;

receive at least one input indicative of an actual force applied by the motor to the cable;

determine an average applied motor force based upon the at least one received input indicative of the actual applied force; and selectively adjust the motor force applied by the motor to thereby adjust the average applied motor force transferred by the cable to the harness which in turn transfers the horizontal resistive force to the waist of the treadmill user as the treadmill user continues walking in the single direction, wherein the processor is configured to increase the average applied motor force when the operative length of the cable exceeds a first predetermined length, and wherein the processor is configured to decrease the average applied motor force when the operative length of the cable is below a second predetermined length that is less than the first predetermined length, and wherein the processor is configured to maintain the average applied motor force when the operative length of the cable is between the first and second predetermined lengths.

2. The system of claim 1, further comprising a position sensor communicatively coupled to the processor, wherein the position sensor is configured to determine a position of a portion of the cable, and wherein the position sensor is configured to provide the input to the processor that is indicative of the translation of the distal end of the cable relative to the motor.

3. The system of claim 2, further comprising a force sensor positioned in-line with the cable, wherein the force sensor is configured to measure the actual force applied between the motor and the treadmill user, and wherein the force sensor is configured to provide the at least one input to the processor that is indicative of the actual applied force.

4. The system of claim 3, wherein the processor is configured to receive an input indicative of a velocity of the cable.

5. The system of claim 4, further comprising a velocity sensor positioned in-line with the cable, wherein the velocity sensor is configured to measure the velocity of the cable.

6. The system of claim 5, wherein the processor is configured to control a speed of cable retraction within a desired velocity range in response to detection of an actual applied force that is below a threshold value, wherein the detection of an actual applied force below the threshold value is indicative of a fault.

7. The system of claim 4, wherein the processor is configured to decrease the motor force applied by the cable when the processor detects a velocity of the cable that exceeds a threshold velocity.

8. The system of claim 1, further comprising the treadmill.

9. The system of claim 8, wherein the treadmill comprises at least one support post and a motor housing, wherein the motor housing is mounted to the at least one support post, and wherein the motor is positioned within the motor housing.

10. The system of claim 9, wherein the motor housing defines an opening, and wherein the cable extends through the opening of the motor housing such that the distal end of the cable is positioned external to the motor housing.

11. The system of claim 1, wherein the motor is a servo motor.

12. The system of claim 1, wherein the cable extends parallel to the single direction in which the treadmill user is walking.

13. A system comprising:

a treadmill comprising at least one support post and a motor housing, wherein the motor housing is mounted to the at least one support post;

a harness configured to transfer a horizontal resistive force to a waist of a treadmill user walking in a single direction on the treadmill;

a cable having a distal end coupled to the harness;

a motor coupled to the cable and configured to apply a motor force to the cable, wherein the cable has an adjustable operative length corresponding to a distance of cable extending outwardly from the motor toward the harness, wherein the cable is configured to transfer the motor force to the harness which in turn transfers the horizontal resistive force to the waist of the treadmill user walking in the single direction; and a system controller comprising a processor communicatively coupled to the motor, wherein the processor is configured to:

receive an input indicative of a translation of the distal end of the cable relative to the motor;

determine the operative length of the cable based upon the translation of the distal end of the cable relative to the motor;

receive at least one input indicative of an actual force applied by the motor to the cable;

determine an average applied motor force based upon the at least one received input indicative of the actual applied force; and selectively adjust the motor force applied by the motor to thereby adjust the average applied motor force transferred by the cable to the harness which in turn transfers the horizontal resistive force to the waist of the treadmill user as the treadmill user continues walking in the single direction, wherein the processor is configured to increase the average applied motor force when the operative length of the cable exceeds a first predetermined length, and wherein the processor is configured to decrease the average applied motor force when the operative length of the cable is below a second predetermined length that is less than the first predetermined length, and wherein the processor is configured to maintain the average applied motor force when the operative length of the cable is between the first and second predetermined lengths.

14. The system of claim 13, further comprising a position sensor communicatively coupled to the processor, wherein the position sensor is configured to determine a position of a portion of the cable, and wherein the position sensor is configured to provide the input to the processor that is indicative of the translation of the distal end of the cable relative to the motor.

15. The system of claim 14, further comprising a force sensor positioned in-line with the cable, wherein the force sensor is configured to measure the actual force applied between the motor and the treadmill user, and wherein the force sensor is configured to provide the at least one input to the processor that is indicative of the actual applied force.

16. A method comprising:

transferring a horizontal resistive force to a treadmill user through a harness as the treadmill user walks in a single direction on a treadmill, the harness being positioned around a waist of the treadmill user, wherein the harness is coupled to a distal end of a cable;

applying, by a motor, a motor force to the cable, wherein the cable has an adjustable operative length corresponding to a distance of cable extending outwardly from the motor toward the harness, wherein the cable is configured to transfer the motor force to the harness which in turn transfers the horizontal resistive force to the waist of the treadmill user walking in the single direction, and wherein the motor is communicatively coupled to a processor of a system controller;

receiving, by the processor, an input indicative of a translation of the distal end of the cable relative to the motor;

determining, by the processor, the operative length of the cable based upon the received input that is indicative of the translation of the distal end of the cable relative to the motor;

receiving, by the processor, at least one input indicative of an actual force applied by the motor to the cable;

determining, by the processor, an average applied motor force based upon the at least one received input that is indicative of the actual applied force; and selectively adjusting, by the processor, the motor force applied by the motor to thereby adjust the average applied motor force transferred by the cable to the harness which in turn transfers the horizontal resistive force to the waist of the treadmill user as the user continues to walk in the single direction, wherein:

when the operative length of the cable exceeds a first predetermined length, the processor increases the average applied motor force;

when the operative length of the cable is below a second predetermined length less than the first predetermined length, the processor decreases the average applied motor force; and when the operative length of the cable is between the first and second predetermined lengths, the processor maintains the average applied motor force.

17. The method of claim 16, further comprising:

detecting, by a position sensor, a position of a portion of the cable, wherein the position sensor is communicatively coupled to the processor; and transmitting, by the position sensor, to the processor, an output indicative of the translation of the distal end of the cable relative to the motor.

18. The method of claim 17, further comprising:

measuring, by a force sensor positioned in-line with the cable the actual force applied between the motor and the treadmill user; and transmitting, by the force sensor, to the processor, an output indicative of the actual applied force.

19. The method of claim 18, further comprising:

measuring, by a velocity sensor positioned in-line with the cable a velocity of the cable;

transmitting, by the velocity sensor, to the processor, an output indicative of the velocity of the cable; and receiving, by the processor, an input indicative of the velocity of the cable.

20. The method of claim 19, further comprising decreasing, by the processor, the motor force applied by the cable when the processor detects a velocity of the cable that exceeds a threshold velocity.

* * * * *